US006287023B1

(12) United States Patent
Yaegashi et al.

(10) Patent No.: US 6,287,023 B1
(45) Date of Patent: Sep. 11, 2001

(54) PROCESSING APPARATUS AND METHOD

(75) Inventors: Hidetami Yaegashi, Kokubunji; Qi Fan, Tokyo, both of (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/157,525

(22) Filed: Sep. 21, 1998

(30) Foreign Application Priority Data

Sep. 22, 1997 (JP) ..... 9-273306

(51) Int. Cl.[7] ..... G03D 5/00; G03D 13/00

(52) U.S. Cl. ..... 396/565; 396/579; 355/30; 422/122

(58) Field of Search ..... 396/604, 611, 396/579; 355/30; 422/119, 120, 122; 55/387, DIG. 30, 46; 118/52, 326; 134/902; 96/234, 228

(56) References Cited

U.S. PATENT DOCUMENTS

| | | | |
|---|---|---|---|
| 5,434,644 | 7/1995 | Kitano et al. | 355/30 |
| 5,607,647 | 3/1997 | Kinkead | 422/122 |
| 5,626,820 | 5/1997 | Kinkead et al. | 422/122 |
| 5,685,895 | 11/1997 | Hagiwara et al. | 96/117 |
| 5,856,198 | 1/1999 | Joffe et al. | 436/100 |
| 5,937,223 * | 8/1999 | Akimoto et al. | 396/604 |
| 5,944,894 * | 8/1999 | Kitano | 118/326 |

FOREIGN PATENT DOCUMENTS

| | | |
|---|---|---|
| 7-142312 | 6/1995 | (JP) . |
| 8-306599 | 11/1996 | (JP) . |
| 8-314152 | 11/1996 | (JP) . |
| 9-250802 | 9/1997 | (JP) . |

* cited by examiner

*Primary Examiner*—D. Rutledge
(74) *Attorney, Agent, or Firm*—Rader, Fishman & Grauer

(57) ABSTRACT

A processing apparatus includes a housing, a plurality of process units arranged within the housing for subjecting an object to a series of processes including coating of processing solution, exposure and development, a transport mechanism for conveying the object to and from the process units, an air cleaning mechanism having a filter for removing impurity which is contained in air introduced into the housing and which lowers resolution, a concentration detection mechanism for detecting the concentration of the impurity in a region outside of the filter, and a life estimation section for estimating the life of the filter in accordance with the result of detection by the concentration detection mechanism.

41 Claims, 8 Drawing Sheets

CURRENT STATUS

FILTER NO. :
FILTER MOUNTED : Y / M / D
TASK NO. :
FILTER LIFE REMAINING : days
AVERAGE CONCENTRATION : ppb
NO. OF DAYS ELAPSED : days

END RECALCULATE RESET

51

FIG.4A

SETTING SCREEN $\alpha$ : days
$\beta$ : ppb
NO. OF DAYS ELAPSED
FROM LAST ANALYSIS : days
AVERAGE CONSTRATION
OF LAST ANALYSIS : ppb

RESET

51

FIG.4B

PROCESSING APPARATUS AND METHOD

BACKGROUND OF THE INVENTION

The present invention relates to a processing apparatus and method for subjecting an object, such as a semiconductor wafer or the like, to a series of processes including application of processing solution, exposure and development.

During the manufacture of semiconductor devices, a circuit pattern is formed by so-called photolithography techniques whereby, after a predetermined film is formed on a semiconductor wafer which is a substrate to be processed, photoresist solution is applied to the wafer to form a resist film thereon, and a predetermined region of the resist film corresponding to the circuit pattern is exposed to light, followed by development.

Conventionally, a series of processes including photoresist coating and development is carried out by a coating-development processing system having different process units incorporated therein. This system includes process units for performing respective processes such as washing, photoresist coating, exposure, development, etc., and a cassette station having a plurality of cassettes placed thereon. The system is also provided with an interface to which an exposure unit is connected.

In the system like this, a semiconductor wafer is taken out of a cassette and transported to a process section by a transport mechanism, and in the process section, the semiconductor wafer is conveyed to and from the individual process units by a main transport mechanism.

The coating-development process is extremely important for high integration of semiconductor devices, and in the case of highly integrated devices such as 64 MB to 256 MB DRAMs, for example, conventional resists do not satisfy the requirements, and thus a chemically amplified resist, which permits formation of finer patterns, needs to be used.

However, the chemically amplified resist is heavily dependent on environment, and if alkaline components, for example, ammonia or organic amines such as NMP (N-methylpyrrolidone), exist in the atmosphere, the resolution is liable to lower. Specifically, in the step of performing a development by supplying developer to the exposed surface of the semiconductor wafer, the circuit pattern formed on the surface of the semiconductor cannot have an accurate wiring width, resulting in rising a problem that high integration cannot be achieved.

Alkaline components, which are a cause of low resolution, are present in the atmosphere because of the use of ammonia in a cleaning fluid for removing fine particles etc. adhering to the surface of an unprocessed semiconductor wafer, the use of an amine solvent as a solvent in a hydrophobic treatment performed on the surface of the semiconductor wafer prior to the step of coating resist solution to the surface of the semiconductor wafer, and the use of an amine solvent in an antireflection film coated to the semiconductor wafer to prevent abnormal exposure during the exposure step. Accurate wiring width is not achieved presumably because such alkaline components flow into the atmosphere for the heating step or the developing step following the exposure step. As a result, a reduction in the yield of IC devices the is caused.

To eliminate the adverse influence of alkaline components, the process units of the coating-development system are placed inside a housing. Air in the housing is forcibly discharged, and a chemical filter, for example, is arranged at an air inlet port which is located at an upper portion of the housing for admitting air to the process units, so as to minimize impurities such as alkaline components which are contained in the air supplied to the interior of the system and which lower the resolution.

However, the capacity of the chemical filter is limited, and if the filter deteriorates, then it is impossible to effectively remove impurities that lower the resolution. As a result, the concentration of resolution-lowering impurities in the individual process units exceeds an allowable value, lowering the yield of IC devices. Therefore, the chemical filter needs to be replaced at appropriate intervals of time, and to this end, a method is employed wherein the atmosphere in each of the process units inside the housing is sampled to measure the concentration of resolution-lowering impurities. With this method, however, the concentration detection requires much time, and thus in the aforementioned system for continuously processing semiconductor wafers, it is inevitable that the system is operated for a long time with a deteriorated chemical filter attached, resulting in a problem of reduction in the yield and reliability of the devices.

BRIEF SUMMARY OF THE INVENTION

An object of the present invention is to provide a high-reliability processing apparatus and method which permit the operator to promptly ascertain the timing for replacement of filters for removing resolution-lowering impurities and which solve the problem of reduction in the yield.

According to a first aspect of the present invention, there is provided a processing apparatus comprising: a housing; a plurality of process units arranged within the housing, for subjecting an object to a series of processes including coating of processing solution and development following exposure; a transport mechanism for conveying the object to and from the process units; an air cleaning mechanism having a filter for removing impurity which is contained in air introduced into the housing and which lowers resolution; a concentration detection section for detecting concentration of the impurity in a region outside of the filter; and a life estimation section for estimating a life of the filter in accordance with a result of detection by the concentration detection section.

According to a second aspect of the present invention, there is provided a processing apparatus comprising: a housing; a plurality of process units arranged within the housing, for subjecting an object to a series of processes including coating of processing liquid, exposure and development; a transport mechanism for conveying the object to and from the process units; an air cleaning mechanism having a filter for removing impurity which is contained in air introduced into the housing and which lowers resolution; a first concentration detection section for detecting concentration of the impurity in a region outside of the filter; one or more second concentration detection sections for detecting concentration of the impurity in a corresponding predetermined region of the processing apparatus inside of the filter; a life estimation section for estimating a life of the filter in accordance with a result of detection by the first concentration detection section; and a monitoring section for monitoring a detection signal from the second concentration detection section.

According to a third aspect of the present invention, there is provide a processing apparatus comprising: a housing; a plurality of process units arranged within the housing, for subjecting an object to a series of processes including coating of processing solution and development following exposure; a transport mechanism for conveying the object to and from the process units; an air cleaning mechanism having a filter for removing impurity which is contained in air introduced into the housing and which lowers resolution; a first concentration detection section for detecting concentration of the impurity in a region outside of the filter; one or more second concentration detection section for detecting concentration of the impurity in a corresponding predetermined region of the processing apparatus inside of the filter; a life estimation circuit for estimating a life of the filter in accordance with a result of detection by the first concentration detection circuit; an arithmetic operation section for comparing a detection signal from the second concentration detection section with a preset threshold; a warning circuit for issuing a warning; and a first control section for outputting a warning signal to the warning section when it is judged by the arithmetic operation section that the detection signal shows a value greater than the preset threshold.

According to a fourth aspect of the present invention, there is provided a processing method for processing an object, comprising the steps of: transferring an object selectively to a plurality of process units arranged within a housing; subjecting the object to a series of processes including coating of processing solution, exposure and development in the process units; removing, by means of a filter, impurity which is contained in air introduced into the housing and which lowers resolution; detecting concentration of the impurity in a region outside of the filter; and estimating a life of the filter in accordance with a result of detection in the concentration detection step.

According to a fifth aspect of the present invention, there is provided a processing method for processing an object, comprising the steps of: transferring an object selectively to a plurality of process units arranged within a housing; subjecting the object to a series of processes including coating of processing solution, exposure and development in the process units; removing, by means of a filter, impurity which is contained in air introduced into the housing and which lowers resolution; detecting concentration of the impurity in a region outside of the filter; detecting concentration of the impurity in one or more regions of the processing apparatus inside of the filter; estimating a life of the filter in accordance with a result of detection of the impurity concentration in the region outside of the filter; and monitoring the impurity concentration in the one or more regions inside of the filter.

According to a sixth aspect of the present invention, there is provided a processing method of processing an object, comprising the steps of: transferring an object selectively to a plurality of process units arranged within a housing; subjecting the object to a series of processes including coating of processing solution, exposure and development in the process units; removing, by means of a filter, impurity which is contained in air introduced into the housing and which lowers resolution; detecting concentration of the impurity in a region outside of the filter; detecting concentration of the impurity in one or more regions inside of the filter; estimating a life of the filter in accordance with a result of detection of the impurity concentration in the region outside of the filter; comparing the impurity concentration in the one or more regions inside of the filter with a preset threshold; and issuing a warning if the impurity concentration detected in the one or more regions inside of the filter is higher than the preset threshold.

According to the first and fourth aspects of the present invention, the concentration of resolution-lowering impurity in the region outside of the filter is detected, and based on the result of detection, the life of the filter is estimated, whereby the timing for replacement of the filter can be determined in advance. High-reliability treatments can therefore be achieved without lowering the yield.

According to the second and fifth aspects of the present invention, the concentration of resolution-lowering impurity in the region outside of the filter is detected, the life of the filter is estimated based on the result of detection, and also the concentration of resolution-lowering impurity in the predetermined region of the processing apparatus inside of the filter is detected and monitored. Accordingly, the timing for replacing the filter can be determined in advance, and also the actual concentration of the impurity inside the housing can be ascertained.

According to the third and sixth aspects of the present invention, the concentration of resolution-lowering impurity in the region outside of the filter is detected, and the life of the filter is estimated based on the result of detection. Further, the concentration of resolution-lowering impurity in the predetermined region of the processing apparatus inside of the filter is detected, a detection signal thereof is compared with the preset threshold, and a warning is issued when the detection signal shows a value greater than the preset threshold. Accordingly, the timing for replacing the filter can be determined in advance, and even if the filter becomes deteriorated before expiration of its estimated life to such an extent that the resolution lowers due to high concentration of the resolution-lowering impurity within the housing, such high impurity concentration can be detected without fail, thus enhancing the reliability of the apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIGS. 4A and 4B are diagrams showing, by way of example, screens displayed at a display device used in the estimation of the life of a filter according to the present invention;

DETAILED DESCRIPTION OF THE INVENTION

Embodiments of the present invention will be hereinafter described in detail with reference to the accompanying drawings.

Figure 1:
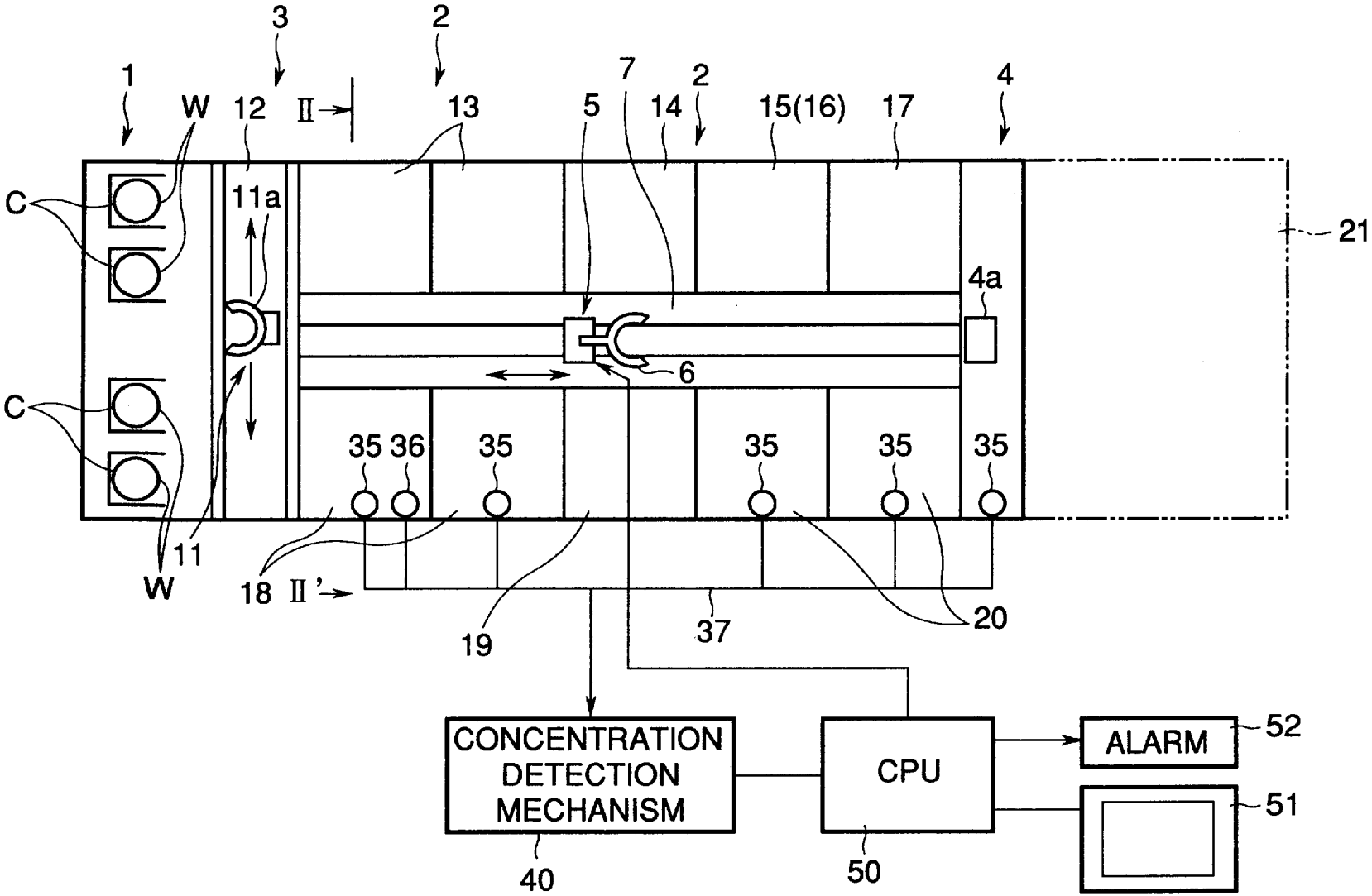
FIG. 1 is a plan view of a coating-development processing system for semiconductor wafers, to which the present invention is applied.
Figure 2:
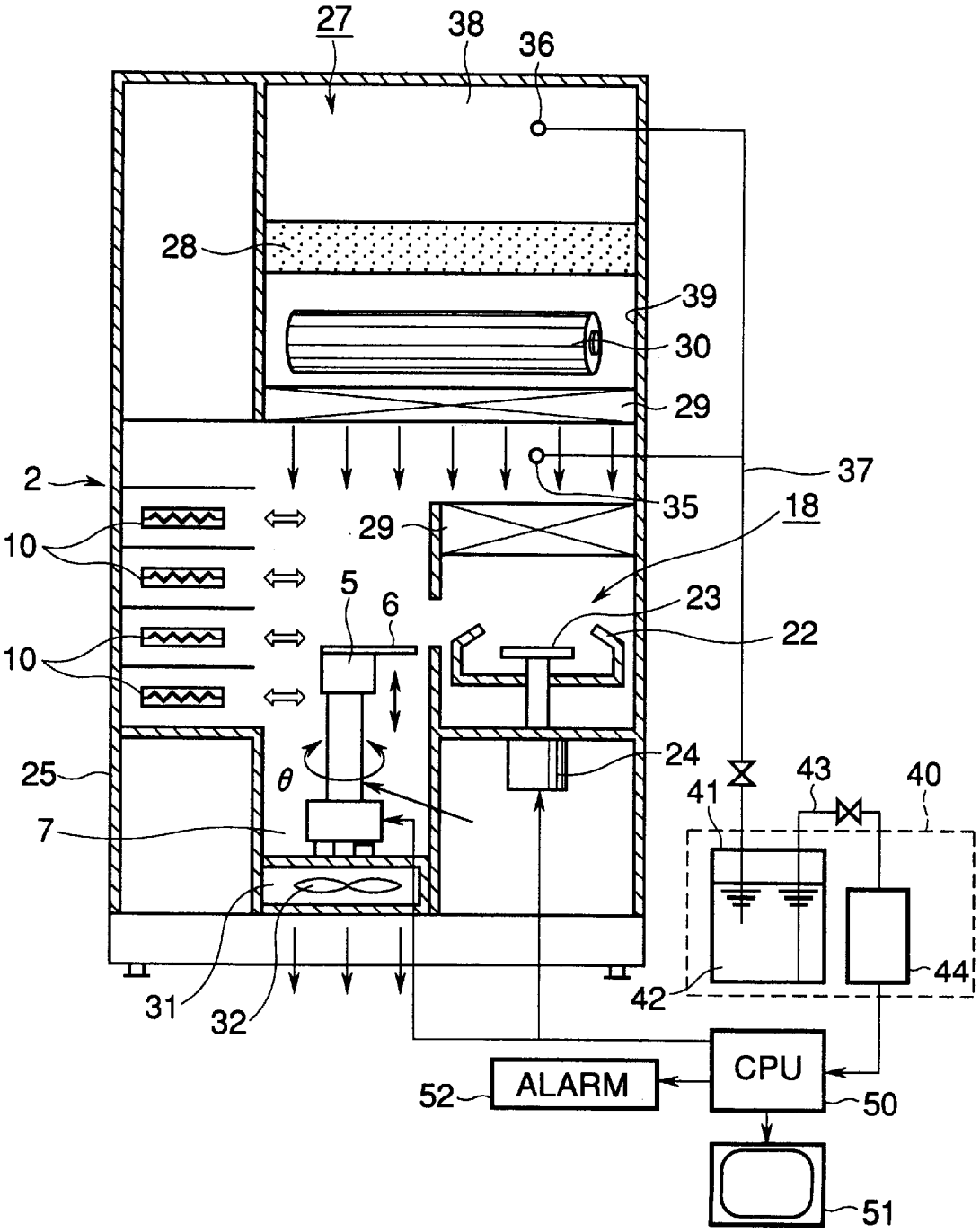
FIG. 2 is a sectional view of the system taken along line II—II' in FIG. 1.

FIG. 1 is a plan view of a coating-development processing system for semiconductor wafers to which the present invention is applied, and FIG. 2 is a sectional view of the system taken along line II—II' in FIG. 1.

The coating-development system comprises a cassette station 1 on which are placed cassettes C containing a plurality of semiconductor wafers W, a process section 2 including a plurality of process units for subjecting the semiconductor wafers W to a series of processes including resist coating and development, a transport mechanism 3 for conveying the semiconductor wafers W between the cassettes C and the process section 2, and an interface section 4 which is arranged on one side of the system opposite the cassette station 1 with the process section 2 interposed therebetween and to which a light exposure unit 21 can be connected in a manner adjacent thereto.

The transport mechanism 3 includes a mechanism 11 movable along a transport path 12 in the direction of arrangement of the cassettes, and this mechanism 11 conveys a semiconductor wafer between the cassette station 1 and the process section 2 while holding the wafer with its arm 11*a*.

The process section 2 has a passage 7 formed substantially at its center, and a plurality of process units are arranged on both sides of the passage 7. The process section 2 is also equipped with a main transport mechanism 5 movable along the passage 7. The main transport mechanism 5 has a wafer supporting arm 6 which is capable of rotary motion, up-and-down motion and advancing/receding motion, and conveys a semiconductor wafer W to an from the individual process units while holding the wafer W with its arm 6.

On one side of the passage 7 are arranged baking units 13, a brush cleaning unit 14, an adhesion process unit 15, a cooling unit 16 situated under the unit 15, and a baking unit 17. On the other side of the passage 7, two resist coating units 18, a water washing unit 19 and two developing units 20 are arranged. Thus, the resist coating units 18 and the developing units 20 are located on one side of the passage 7 while the baking units 13 and 17 are located on the other, so that the resist coating units 18 and the developing units 20 are prevented from being affected by heat.

The interface section 4 is provided with a table 4*a* for placing a semiconductor wafer W thereon, and each semiconductor wafer W is transferred to and from the exposure unit 21 via the table 4*a*. In the exposure unit 21, a predetermined circuit pattern is formed on the semiconductor wafer W having a resist applied thereto, with the use of a photomask or the like.

By integrating different process units into one body in this manner, it is possible to save space and improve the efficiency of the treatments. The process section 2 including the aforementioned process units is arranged within a housing 25 (see FIG. 2), and the system is in its entirety arranged in a clean room.

In the coating-development processing described above, a semiconductor wafer W in a cassette C is transported to the process section 2 and is then subjected successively to cleaning in the brush cleaning unit 14 and in the water washing unit 17, hydrophobic treatment in the adhesion process unit 15 to enhance the adhesion of the resist, cooling in the cooling unit 16, and application of a resist of chemically amplified type in one of the resist coating units 18. Subsequently, the semiconductor wafer W is subjected to prebaking in one of the baking units 13, followed by cooling in the cooling unit 16, and after the semiconductor wafer W is transported to the exposure unit 21 via the interface section 4, it is exposed to a predetermined pattern of light. The semiconductor wafer W is again conveyed to the process section 2 via the interface section 4 and subjected to postexposure baking in the baking unit 17 to chemically amplify the resist. Then, after the semiconductor wafer W is cooled in the cooling unit 16, it is subjected to development in one of the developing units 20 to form a predetermined circuit pattern thereon, and the residual developer is washed off using rinsing solution. The semiconductor wafer W which has thus been subjected to development is conveyed and placed in a predetermined cassette C on the cassette station 1 by the main transport mechanism 5 and the transport mechanism 3. Where an antireflection film is to be formed on the surface of the semiconductor wafer W, the wafer W is coated with a resist for antireflection in the other of the resist coating units 18, then baked, and applied with the chemically amplified resist.

An air cleaning mechanism and an impurity concentration detection mechanism for detecting the concentration of impurities that lower the resolution, both provided in the coating-development system of this embodiment, will be now described. As shown in FIG. 2, an air cleaning mechanism 27 is arranged above the process section 2, for supplying clean air to the interior of the process section 2. The air cleaning mechanism 27 is located within a passage 39 through which air is introduced into the process section 2 from a duct 38 situated at an uppermost portion of the housing 25, and comprises a chemical filter 28, a blowing fan 30, and a ULPA filter 29 arranged in this order from top downward. Air cleaned by the air cleaning mechanism 27 flows downward and is supplied to the process section 2, and among the elements constituting the mechanism 27, the chemical filter 28 has the function of removing alkaline components that lower the resolution of the chemically amplified resist, for example, ammonia, organic amines such as NMP (N-methylpyrrolidone), etc., and thereby preventing reduction in the resolution. The chemical filter 28 is provided for each of the process units. The ULPA filter 29 is also arranged at an air inlet of the resist coating unit 18 located below the air cleaning mechanism 27 but may be omitted.

At the bottom of the passage 7 of the process section 2, an air discharge passage 31 is formed in which a discharge fan 32 is arranged so that the air taken in from above may be forcibly discharged downward. Accordingly, impurities which lower the resolution, if present in the process section 2, are discharged downward to the outside of the system and thus do not adversely affect the semiconductor wafers W.

In the resist coating unit 18, for example, a spin chuck 23 is arranged inside a cup 22 for preventing scattering of the resist, as shown in FIG. 2, and a semiconductor wafer W is attracted by vacuum suction to the spin chuck 23. Air cleaned by the air cleaning mechanism 27 is introduced into the cup 22 from above, and while the semiconductor wafer W is rotated together with the spin chuck 23 by a pulse motor 24, resist solution is fed from a nozzle (not shown), whereby resist film coating is performed.

The interface section 4 also is provided with an air cleaning mechanism similar to the mechanism 27 described above, so that clean air is supplied to the interface section 4 as well.

As shown in FIGS. 1 and 2, air inlet ports 35 open to the interiors of the resist coating units 18, the developing units 20 and the interface section 4 at locations immediately below the air cleaning mechanisms 27, and an air inlet port 36 opens at a location outside of the chemical filter 28. These air inlet ports 35 and 36 are connected to a concentration detection mechanism 40 through sampling pipes 37, and the concentration detection mechanism 40 detects the concentration of resolution-lowering impurities in the sampled air, for example, the concentration of ammonia.

The concentration detection mechanism 40 comprises a tank 41 containing pure water 42, and a concentration analysis section 44. A delivery pipe 43, which is provided with an air intake fan (not shown), has an end portion inserted into the pure water 42 in the tank 41. Air taken in from the air inlet ports 35 or from the port 36 is introduced into the tank through the sampling pipes 37 and dissolved in the pure water, and the pure water in which ammonia is dissolved is guided to the concentration analysis section 44 through the delivery pipe 43. In the concentration analysis section 44, analysis of ammonia etc. is performed.

The result of the analysis by the concentration analysis section 44 is output to a CPU 50, which then executes a predetermined process, whereupon a display device 51 displays a predetermined screen and, if the occasion arises, an alarm device 52 displays a warning message or an alarm is sounded or both of these are carried out. The CPU 50 is also connected to the motor of the main transport mechanism 5, the motor 24 of the spin chuck 23, etc., to control the elements connected thereto. Motors associated with spin chucks in the developing units 20 can also be controlled by the CPU.

Air taken in from the air inlet port 36 located outside of the chemical filter 28 is the air from which impurities that lower the resolution are not yet removed by the chemical filter, that is, the air in the clean room in which the coating-development system is arranged. By detecting the concentration of such resolution-lowering impurities in this air, for example, the concentration of ammonia, with the use of the concentration detection mechanism 40, it is possible to determine to what degree impurities are to be trapped in the chemical filter. Since the capacity of the chemical filter can be determined in terms of a total amount of trapped impurities, the lifetime of the chemical filter can be estimated by regularly detecting the concentration of impurities in the air which is not yet passed through the chemical filter.

In this case, the CPU 50 functions as a life estimation section for estimating the life of the chemical filter based on the result of concentration detection. Specifically, the CPU 50 is supplied with the result of detection of the concentration of impurities contained in the air outside of the chemical filter 28, and based on the input data, calculates an average remainder of the life of the chemical filter.

More specifically, the concentration of impurities in the air taken in from the air inlet port 36 is periodically measured, and the CPU 50 calculates an average concentration C according to equation (1) below.

$$C=\Sigma(a\times b)/\Sigma a \quad (1)$$

where a represents the number of days between the previous analysis and the current analysis, and b represents the value obtained in the latest analysis.

Then, the number of remaining days R of the life is calculated according to equation (2).

$$R=\{\alpha\times\beta-\Sigma(a\times b)\}/C \quad (2)$$

where $\alpha$ is the term (days), $\beta$ is the concentration, and $\alpha\times\beta$ represents the lifetime of a new filter, that is, the capacity of the filter. Specifically, $\alpha\times\beta$ indicates the capacity of the filter, for example, $\alpha$=1 year if the concentration $\beta$ is 2 ppb, and $\alpha$=2 years if the concentration $\beta$ is 1 ppb.

Figure 3:
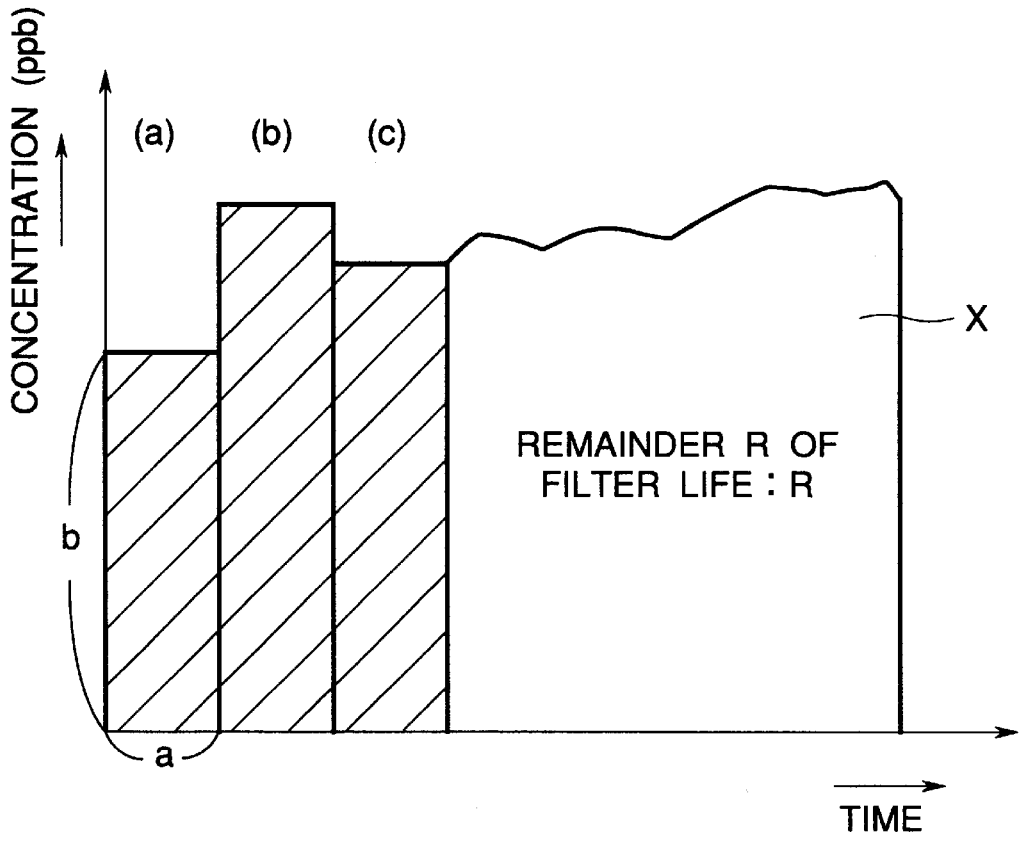
FIG. 3 is a conceptual diagram illustrating an example of how the life of a filter is estimated according to the present invention.

More specifically, based on the results of concentration detection in past analyses (a), (b) and (c) as shown in FIG. 3, an average concentration is calculated, then a hatched area which indicates the degree of past consumption is subtracted from the filter capacity to obtain an area indicated at X, and the obtained area is divided by the average concentration to obtain the remainder R of the life.

The CPU 50 performs the aforementioned calculations for each of the filters, and data on each filter, such as the remainder of the life, is displayed at the display device 51. Specifically, two screens, that is, a current status screen and a setting screen shown in FIGS. 4A and 4B, respectively, are prepared for each of the filters for management of the lives of the filters. The screens are prepared for each of the filters because the filters are mounted on different days and thus the remainders of their lives are different. Also, the setting screen is prepared separately from the status screen in order that the data may not be altered carelessly by changing the value $\alpha$ or $\beta$ by pressing the reset button.

In this manner, the lives of the chemical filters can be estimated, so that the timing for replacement of the individual filters can be determined in advance. This prevents defective products from being produced due to deterioration of the filters, and accordingly, high-reliability processes can be achieved without reduction in the yield. Also, the concentration of resolution-lowering impurities, for example, the concentration of ammonia etc., is integrated for the operation hours, and based on the integrated value, that is, based on the value reflecting the past measurements, the lives of the filters are estimated. It is therefore possible to detect the degree of deterioration of the filters with accuracy, permitting high-accuracy estimation of the lives of the filters.

The display device 51 may also be used for monitoring the concentration of impurities in the air outside of the chemical filters 28, that is, the air in the clean room, to control the air in the clean room so that the concentration of resolution-lowering impurities may be lower than a limit value of, for example, 10 ppb.

Figure 5:
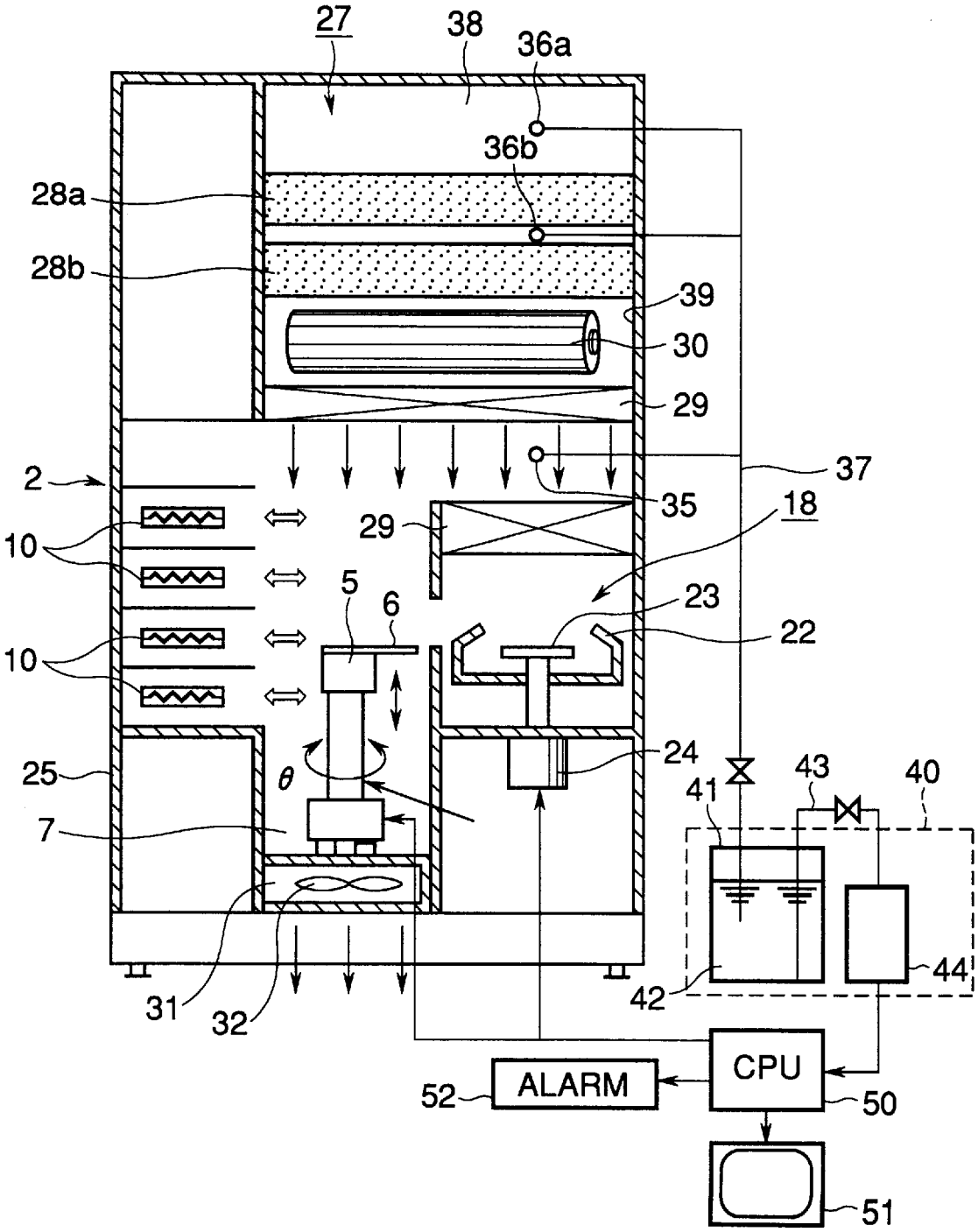
FIG. 5 is a sectional view of an coating-development processing system for semiconductor wafers according to another embodiment of the present invention.

The above embodiment uses a single layer of chemical filter, but two layers 28*a* and 28*b* of chemical filter as shown in FIG. 5 may be used, in which case resolution-lowering impurities can be removed with higher reliability. In this embodiment, an air inlet port 36*a* opens at a location outside of the upper chemical filter 28*a,* and another air inlet port 36*b* opens at a location between the two chemical filters 28*a* and 28*b*. Following the procedure described above, the life of the chemical filter 28*a* can be estimated by detecting the concentration of impurities in the air taken in from the air inlet port 36*a,* and also the life of the chemical filter 28*b* can be estimated by detecting the concentration of impurities in the air taken in through the air inlet port 36*b*. Similarly, where filters are arranged in three or more stages, the life of each filter can be estimated by detecting the concentration of impurities in the air present between corresponding two adjacent filters.

By arranging filters in layers and estimating the life of each filter, it is possible to replace filters while maintaining high cleanness inside the system. Specifically, when it is judged that one filter needs replacement, it may be detached and the cleanness inside the system never lowers if the lives of the other filters have not expired.

If the amount of impurities caught in a chemical filter reaches about 70% of its adsorptivity, then the filtering capacity of the chemical filter thereafter lowers. In the case of a single-stage chemical filter, therefore, the filter must be discarded when about 70% of its adsorptivity is reached. However, in the case of chemical filters arranged in multiple stages, the filters can be used up to about 100% of their adsorptivity. Specifically, the amount of impurities adsorbed to outer chemical filters may be greater than 70% of their adsorptivity if only the amount of impurities adsorbed to the innermost chemical filter is smaller than 70% of the adsorptivity, so that the chemical filters can be used almost up to 100% of their adsorptivity.

Figure 6A:
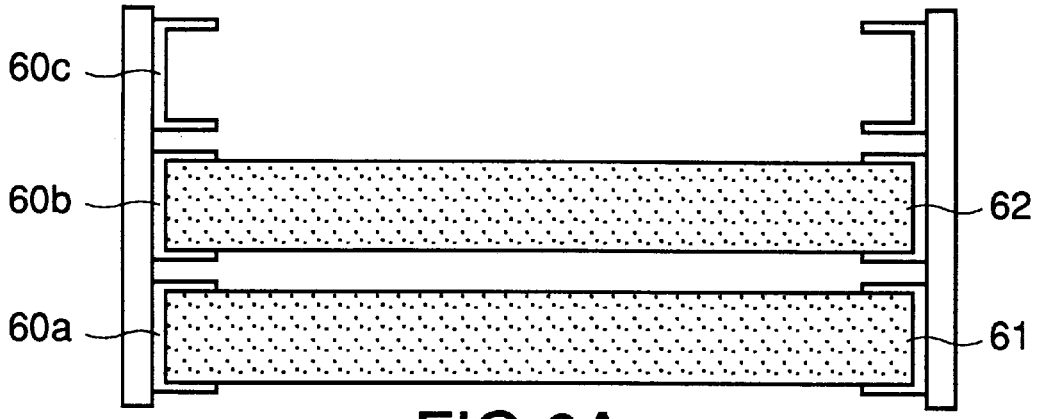
FIGS. 6A to 6C are diagrams showing an example of how filters are changed in position where filters are arranged in multiple stages.
Figure 6B:
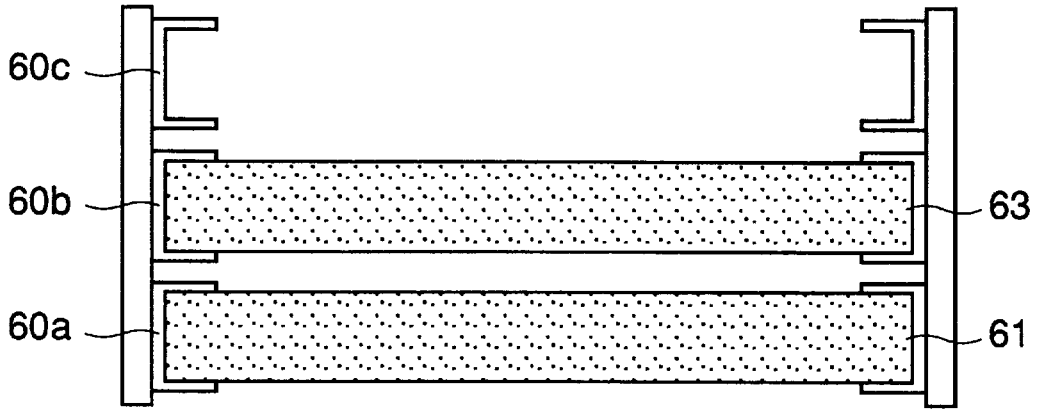
Figure 6C:
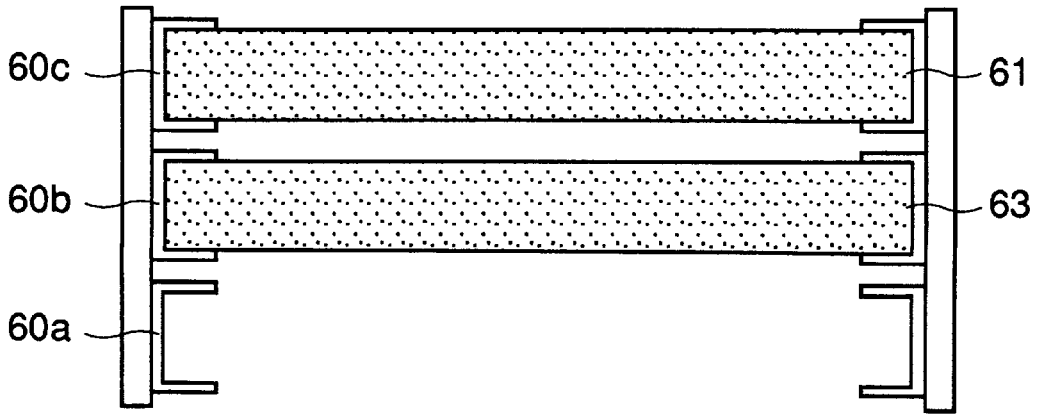

This will be explained with reference to: FIGS. 6A to 6C illustrating a specific procedure for changing chemical filters. Three-stage mounting ports 60*a*, 60*b* and 60*c* are provided for chemical filters, and chemical filters are mounted to two of the three ports as illustrated. As shown in FIG. 6A, chemical filters 61 and 62 are mounted respectively to the ports 60*a* and 60*b*. When the chemical filter 62 has come to an end in the life and needs to be replaced, the filter 62 is replaced with a new chemical filter 63, as shown in FIG. 6B. Then, as shown in FIG. 6C, the chemical filter 61 is detached and mounted to the outermost port 60*c*. Since the chemical filter 61 is thus located outside of the new filter, it can be used almost up to 100% of its adsorptivity.

Where chemical filters are arranged in two stages as stated above, the total number of screens greatly increases if the two screens, that is, the current status screen and the setting screen shown in FIGS. 4A and 4B, respectively, are prepared for each of the filters. To avoid this, the remainders of the lives of the upper and lower filters may be displayed on a single screen, whereby the number of screens can be reduced by half.

The timing for replacement of the individual chemical filters can be ascertained in this manner. By detecting also the actual concentration of impurities in each of the resist coating units 18, the developing units 20 and the interface section 4, it is possible to cope with a situation where the filters become deteriorated before expiration of their estimated lives.

To this end, according to this embodiment, the air inlet ports 35 are formed so as to open to the interiors of the resist coating units 18, the developing units 20 and the interface section 4 at locations immediately below the air cleaning mechanisms 27, as mentioned above, and the concentration of resolution-lowering impurities, for example, the concentration of ammonia contained in the air taken in through the individual air inlet ports is detected by the concentration detection mechanism 40.

A detection signal from the concentration detection mechanism 40 is input to the CPU 50, and the detected concentration is displayed at the display device 51 which serves as a monitoring device. This permits actual concentrations of impurities in the resist coating units 18, the developing units 20 and the interface section 4 to be ascertained at all times.

The detection signal input to the CPU 50 is compared with a preset threshold. Specifically, if the limit value at and below which impurities do not adversely affect the resolution is 1 ppb, for example, this value is set as the threshold to be compared with the detected value by the CPU 50. If the impurity concentration exceeds 1 ppb, the CPU 50 supplies a command to the alarm device 52 which then gives a warning. As such warning, a warning message is displayed or an alarm is sounded or both of these are performed. The warning message may be displayed at the display device 51. The alarm device 52 may also be operated in cases where the concentration of impurities in the air taken in from the outside of the filter 28 or 28*a* or between the filters 28*a* and 28*b* is higher than a predetermined value.

Thus, the concentration of resolution-lowering impurities is detected for each of the resist coating units 18, the developing units 20 and the interface section 4 which can be adversely affected by such impurities, and a warning is issued if the impurity concentration becomes higher than the allowable limit of, for example, 1 ppb. It is therefore possible to replace chemical filters without fail even in the case of unexpected deterioration of filters that cannot be detected by the life estimation described above. If, in this case, the threshold for comparison by the CPU 50 is set to a value smaller than the allowable limit value, for example, 0.7 ppb, then more time is allowed for the replacement of filters.

When the threshold is exceeded in any of the resist coating units 18, the developing units 20 and the interface section 4, the CPU 50 sends a stop command to individual driving sections to stop the treatments. By stopping the processes, it is possible to prevent reduction in the yield with high reliability.

The processes may be brought to a stop in various ways. Namely, when the detected value of impurity concentration has become greater than the threshold of, for example, 1 ppb, all of the processes may be immediately stopped, or the processes may be stopped after completion of process of unprocessed wafers remaining in the process section 2 etc. In the former case, it is possible to prevent without fail the yield of wafers from reducing due to low resolution, but the unprocessed wafers remaining in the process section 2 are wasted. In the latter case, on the other hand, the wafers W are not wasted, though they may be affected by low resolution. Either of the two methods may be employed according to circumstances.

Also, when it is judged that the detected value of the impurity concentration in any of the resist coating units 18, the developing units 20 and the interface section 4 has become greater than the threshold, the CPU 50 may control the main transport mechanism 5 in such a manner that the semiconductor wafers W are inhibited from entering that unit or section of which the impurity concentration is abnormally high.

In this case, although the semiconductor wafers W are prevented from being transported to that unit or section of which the detected value of impurity concentration is greater than the threshold, the other units/section can continue their processes, whereby reduction in the yield is prevented without fail and also reduction in the throughput can be minimized.

The CPU 50 has the function of automatically issuing a re-detection command in case of an abnormal situation where the impurity concentrations detected in the resist coating units 18, the developing units 20 and the interface section 4 are different from one another by a predetermined value or more. Thus, the detection can be verified and the cause of trouble located.

Figure 7:
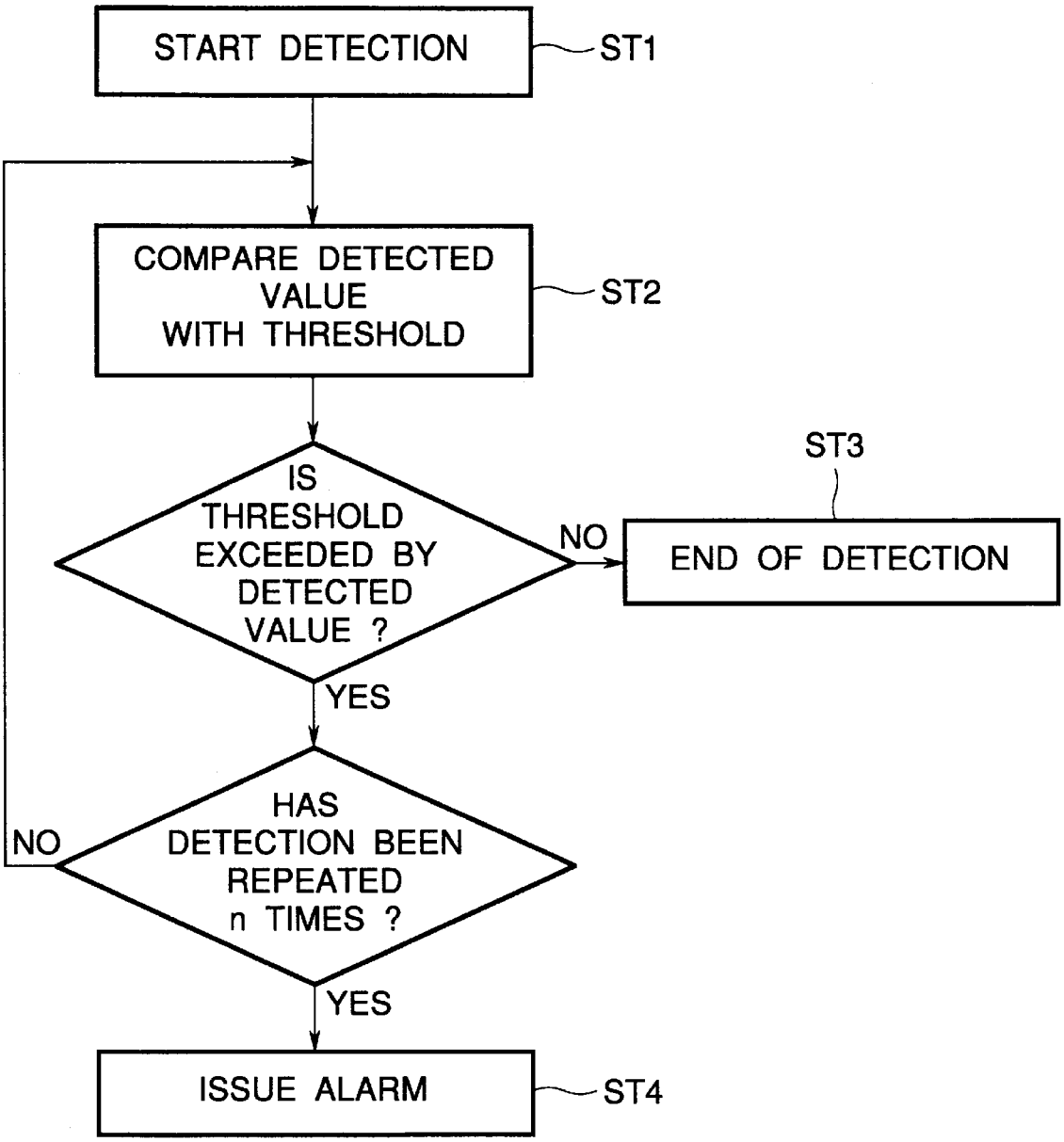
FIG. 7 is a flowchart showing a preferred mode of detecting the concentration of impurities according to the present invention.

Further, the CPU 50 has the function of automatically issuing a re-detection command in cases where the impurity concentration detected in any one of the resist coating units 18, the developing units 20 and the interface section 4 is greater than the aforementioned threshold. More specifically, as shown in FIG. 7, the detection is initiated first (ST1), and the detected value is compared with the threshold (ST2). If the detected value is smaller than or equal to the threshold, this process is ended (ST3). On the other hand, if the detected value is greater than the threshold, re-detection is performed. If the values detected consecutively n times are found to be greater than the threshold, a signal is output to the alarm device 52, which then issues an alarm (ST4). Subsequently, suitable control is executed to stop the ongoing treatments or to inhibit the semiconductor wafers W from entering the unit or section of which the impurity concentration is greater than the threshold, as stated above.

Thus, the concentration detection is repeated a plurality of times. Accordingly, even in the case where the result of a single concentration detection operation shows an abnormal value due to impurities or the like adhering to the piping, for example, high-accuracy measurement of impurity concentration is ensured because the detection is repeated a plurality of times.

Such repeated detection may be performed also in the case of the detection of impurity concentration in the region outside of the chemical filter 28, in addition to the detection of impurity concentration in the resist coating units 18, the developing units 20 and the interface section 4. Also in this case, re-detection may be performed when the result of concentration detection shows a value greater than a predetermined value, whereby the impurity concentration can be measured with higher accuracy.

Figure 8:
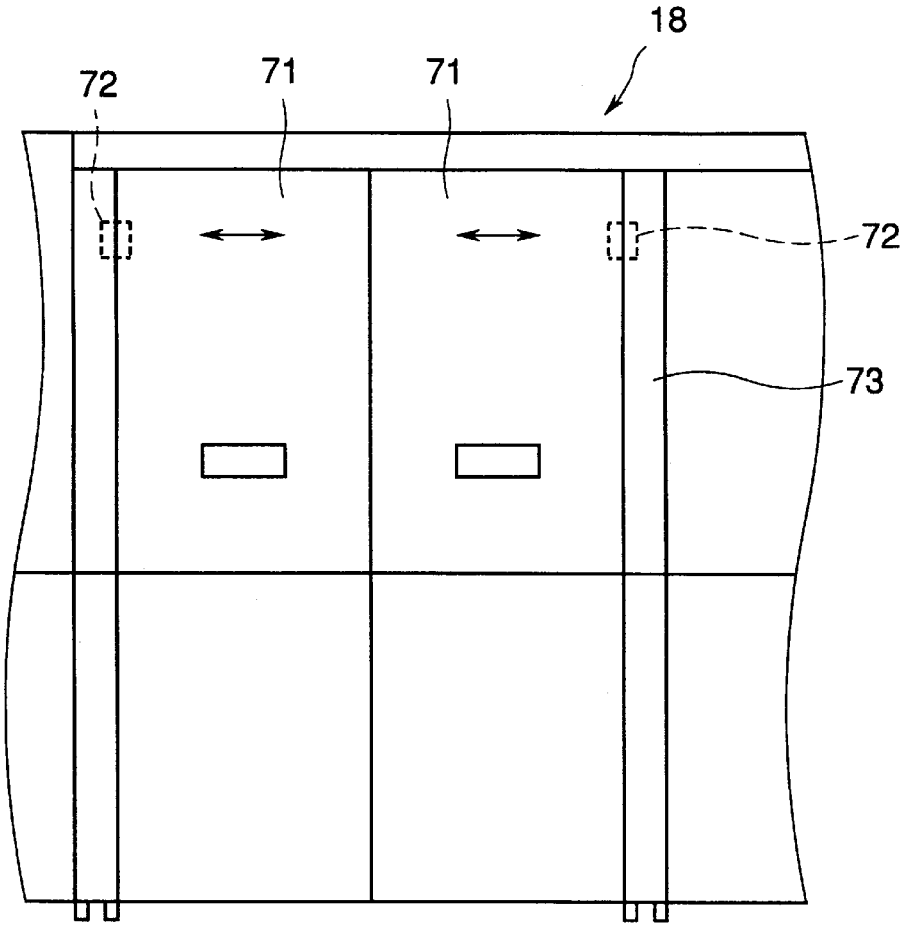
FIG. 8 is a side view of a resist coating unit in the system shown in FIG. 1.
Figure 9A:
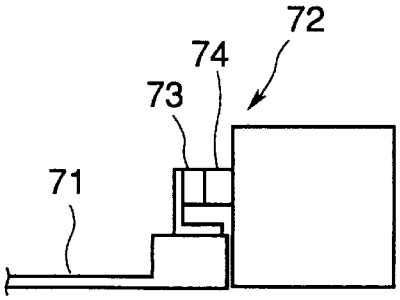
FIGS. 9A and 9B are diagrams illustrating the principle in accordance with which opening motion of a door of the resist coating unit is detected by a magnet sensor.
Figure 9B:
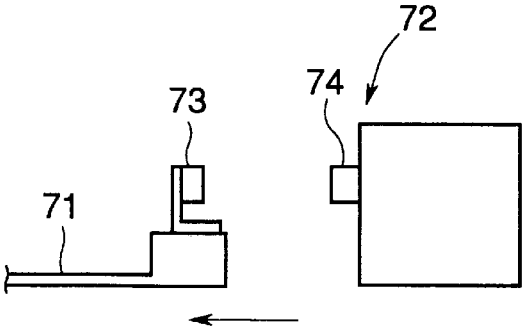

Each of the resist coating units 18 and the developing units 20 is provided with doors for facilitating maintenance. One of the resist coating units 18, for example, has two slidable doors 71 on one side thereof opposite the passage 7, as shown in FIG. 8. Reference numeral 73 denotes a support. Magnet sensors 72 are arranged each at a location where the corresponding door is opened and closed. As shown in FIG. 9A, each magnet sensor 72 comprises a magnet 73 attached to the corresponding door 71, and a detecting section 74 mounted to the corresponding support 73. As either of the doors 71 is opened as shown in FIG. 9B, the corresponding magnet 73, which was located near the detecting section 74 associated therewith when the door was closed, moves away from the detecting section 74 and thus the magnetic field detected by the detecting section 74 varies, whereby the opening motion of the door 71 is detected. When either of the doors 71 is opened for maintenance, the CPU 50 outputs a warning signal to the alarm device 52, so that a required operation, such as suspension of the process, can be promptly executed.

On receiving a detection signal indicating that the door 71 is opened, the CPU 50 may output a command to the main transport mechanism 5 to inhibit access to the process unit whose door has been opened (in this case, the resist coating unit 18), as well as a command to the concentration detection mechanism 40 to stop detection of the impurity concentration in the same process unit. Such control serves to prevent an awkward situation where, for example, the main transport mechanism 5 touches the operator while transporting a semiconductor wafer W, and also serves to omit unnecessary concentration detection, making it possible to efficiently carry out the impurity concentration detection which consumes time.

The present invention is not limited to the foregoing embodiments and may be modified in various ways.

For example, although in the above embodiments, one resist coating-development system is equipped with one concentration detection mechanism, a single concentration detection mechanism may be used for a plurality of systems, or conversely, a concentration detection mechanism may be provided for each of the air inlet ports.

Also, in the foregoing embodiments, the concentration of impurities in each of the resist coating units, the developing units and the interface section is detected, but it is not essential to detect the impurity concentration of all these units. Further, the impurity concentration of other portions such as the passage may also be measured.

The screen showing a chemical filter status is also not limited to the one illustrated in FIGS. 4A and 4B and may be suitably set in various ways. Further, instead of arranging two chemical filters in layers, a single filter may be used or three or more filters may be arranged in layers.

Furthermore, the arrangement of the individual units in the resist coating-development system is not limited to that of the foregoing embodiments. The object is also not limited to the semiconductor wafer and may of course be other objects such as LCD substrates.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A processing apparatus comprising:

a housing;

a plurality of process units arranged within said housing and configured to subject an object to a series of processes including coating of processing solution and development following exposure;

a transport mechanism configured to convey the object to and from said process units;

an air cleaning mechanism having a filter configured to remove impurity which is contained in air introduced into said housing and which lowers resolution;

a concentration detection section configured to detect impurity concentrations in regions outside and inside of the filter; and a life estimation section for estimating a life of the filter in accordance with a result of detection by said concentration detection section.

2. The processing apparatus according to claim 1, wherein said filter includes a plurality of filters arranged in layers.

3. A processing apparatus comprising:

a housing:

a plurality of process units arranged within said housing, and configured to subject an object to a series of processes including coating of processing solution and development following exposure;

a transport mechanism configured to remove the object to and from said process units;

an air cleaning mechanism having a filter configured to remove impurity which is contained in air introduced into said housing and which lowers resolution;

a concentration detection section configured to detect impurity concentrations in region outside of and inside the filter; and a life estimation section for estimating a life of the filter in accordance with a result of detection by said concentration detection section, wherein said life estimation section integrates the concentration detected by said concentration detection section for an operating time, and estimates the life of the filter based on the integrated value.

4. A processing apparatus comprising:

a housing;

a plurality of process units arranged within said housing and configured to subject an object to a series of processes including coating of processing solution and development following exposure;

a transport mechanism configured to convey the object to and from said process units;

an air cleaning mechanism having a filter configured to remove impurity which is contained in air introduced into said housing and which lowers resolution, said filter including a plurality of filter members arranged in layers;

a concentration detection section configured to detect impurity concentrations in regions outside and inside of the filter;

a life estimation section for estimating a life of the filter in accordance with a result of detection by said concentration detection section;

one or more additional concentration detection sections arranged between corresponding adjacent two of the filter members and configured to detect impurity concentrations which lower the resolution.

5. A processing apparatus comprising:

a housing;

a plurality of process units arranged within said housing and configured to subject an object to a series of processes including coating of processing solution and development following exposure;

a transport mechanism configured to convey the object to and from said process units;

an air cleaning mechanism having a filter configured to remove impurity which is contained in air introduced into said housing and which lowers resolution;

a concentration detection section configured to detect impurity concentrations in regions outside and inside of the filter; and a life estimation section for estimating a life of the filter in accordance with a result of detection by said concentration detection section, wherein at least one of said process units has a door which is closed while the object is under treatment, and said processing apparatus further comprises a control section for outputting a warning signal to warning means when the door of said at least one process unit is opened.

6. The processing apparatus according to claim 5, wherein said control section outputs a signal to said transport mechanism to inhibit access to the process unit whose door is open, and outputs a signal to said additional concentration detection sections associated with the process unit whose door is open, to stop detection.

7. A processing apparatus comprising:

a housing;

a plurality of process units arranged within said housing, for subjecting an object to a series of processes including coating of processing solution and development following exposure;

a transport mechanism for conveying the object to and from said process units;

an air cleaning mechanism having a filter for removing impurity which is contained in air introduced into said housing and which lowers resolution;

a first concentration detection section for detecting concentration of the impurity in a region outside of the filter;

one or more second concentration detection section for detecting concentration of the impurity in a corresponding predetermined region of said processing apparatus inside of the filter;

a life estimation section for estimating a life of the filter in accordance with a result of detection by said first concentration detection section; and a monitoring section for monitoring a detection signal from said second concentration detection section.

8. The processing apparatus according to claim 7, wherein said life estimation section integrates the concentration detected by said first concentration detection section for an operating time, and estimates the life of the filter based on the integrated value.

9. The processing apparatus according to claim 7, wherein at least one of said process units has a door which is closed while the object is under treatment, and said processing apparatus further comprises a control section for outputting a warning signal to warning means when the door of said at least one process unit is opened.

10. The processing apparatus according to claim 9, wherein said control section outputs a signal to said transport mechanism to inhibit access to the process unit whose door is open, and outputs a signal to said second concentration detection section associated with the process unit of which the door is open, to stop detection.

11. The processing apparatus according to claim 7, wherein said filter includes a plurality of filters arranged in layers.

12. The processing apparatus according to claim 11, further comprising one or more third concentration detection section arranged between corresponding adjacent layers of the filters for detecting concentration of impurity which lowers the resolution.

13. A processing apparatus comprising:

a housing;

a plurality of process units arranged within said housing, for subjecting an object to a series of processes including coating of processing solution and development following exposure;

a transport mechanism for conveying the object to and from said process units;

an air cleaning mechanism having a filter for removing impurity which is contained in air introduced into said housing and which lowers resolution;

first concentration detection section for detecting concentration of the impurity in a region outside of the filter;

one or more second concentration detection sections for detecting concentration of the impurity in a corresponding predetermined region of said processing apparatus inside of the filter;

life estimation means for estimating a life of the filter in accordance with a result of detection by said first concentration detection section;

arithmetic operation means for comparing a detection signal from said second concentration detection section with a preset threshold;

a warning unit for issuing a warning; and a first control section for outputting a warning signal to said warning unit when it is judged by said arithmetic operation section that the detection signal shows a value greater than the preset threshold.

14. The processing apparatus according to claim 13, wherein said life estimation section integrates the concentration detected by said first concentration detection section for an operating time, and estimates the life of the filter based on the integrated value.

15. The processing apparatus according to claim 13, further comprising second control section for stopping process of the object when it is judged by said arithmetic operation section that the detection signal shows a value greater than the preset threshold.

16. The processing apparatus according to claim 13, further comprising a third control section, wherein when it is judged by said arithmetic operation section that the detection signal from said second concentration detection section associated with a corresponding predetermined region of said processing apparatus inside of the filter shows a value greater than the preset threshold, said third control section controls said transport mechanism such that the object is inhibited from being conveyed to said predetermined region.

17. The processing apparatus according to claim 13, further comprising a fourth control section for outputting a command to said second concentration detection section to repeat detection when the impurity concentration detected by said second concentration detection section is higher than the preset threshold, for outputting a warning signal to said warning unit if the detected impurity concentration remains higher than the preset threshold after the detection is repeated a predetermined number of times, and for outputting a signal to stop the repeated detection when the detected impurity concentration has become lower than or equal to the preset threshold while the detection is repeated.

18. The processing apparatus according to claim 17, wherein said fourth control section outputs a command to said first concentration detection section to repeat detection when the impurity concentration detected by said first concentration detection section is higher than a preset value, outputs a warning signal to said warning unit if the detected impurity concentration remains higher than the preset value after the detection is repeated a predetermined number of times, and outputs a signal to stop the repeated detection when the detected impurity concentration has become lower than or equal to the preset value while the detection is repeated.

19. The processing apparatus according to claim 13, wherein at least one of said process units has a door which is closed while the object is under treatment, and said processing apparatus further comprises a fifth control section for outputting a warning signal to said warning unit when the door of said at least one process unit is opened.

20. The processing apparatus according to claim 19, wherein said fifth control section outputs a signal to said transport mechanism to inhibit access to the process unit of which the door is open, and outputs a signal to said second concentration detection section associated with the process unit of which the door is open, to stop detection.

21. The processing apparatus according to claim 13, wherein said filter includes a plurality of filters arranged in layers.

22. The processing apparatus according to claim 21, further comprising one or more third concentration detection sections arranged between corresponding adjacent layers of the filters for detecting concentration of impurity which lowers the resolution.

23. A processing method for processing an object, comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into said housing and which lowers resolution;

detecting impurity concentrations in regions inside and outside of said filter; and estimating a life of the filter in accordance with a result of detection in said concentration detection step.

24. A processing method for processing an object comprising the steps of:

transferring an object selectively to and from a plurality of process units arranged within a housing;

subjecting the object to a series of processes including coating of processing solution exposure and development in said process units;

removing, by means of a filter, impurity which is contained in air introduced into said housing and which lowers resolution;

detecting impurity concentrations in regions outside and inside of said filter; and estimating a life of the filter in accordance with a result of detection in said concentration detection step, wherein said step of estimating a life of the filter comprises integrating impurity the concentrations detected in the region outside of the filter for an operating time, and estimating the life of the filter based on the integrated value.

25. A processing method for processing an object, comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into said housing and which lowers resolution;

detecting impurity concentrations in regions outside and inside of said filter; and estimating a life of the filter in accordance with a result of detection in said concentration detection step, wherein at least one of the process units has a door which is closed while the object is under treatment, and said processing method further comprises the step of issuing a warning when the door of said at least one process unit is opened.

26. The processing method according to claim 25, further comprising the step of inhibiting access of the transport mechanism to said at least one process unit and stopping detection of the impurity concentration in said at least one process unit when the door of said at least one process unit is opened.

27. A processing method for processing an object, comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into said housing and which lowers resolution;

detecting impurity concentrations in region outside and inside of said filter; and estimating a life of the filter in accordance with a result of detection in said concentration detection step, wherein said filter includes a plurality of filter members arranged in layers, said processing method further comprises the step of detecting impurity concentrations in a region between adjacent two of the filter members, and said step of estimating a life of the filter comprises detecting the impurity concentrations in the region outside of the filter and the impurity concentrations in the region between adjacent two of the filters members.

28. A processing method for processing an object, comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into the housing and which lowers resolution;

detecting impurity concentrations in a region outside of said filter;

detecting impurity concentrations in one or more regions inside of the filter;

estimating a life of the filter in accordance with a result of detection of the impurity concentration in regions inside and outside of the filter; and monitoring the impurity concentration in said one or more regions inside of the filter.

29. A processing method for processing an object, comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into the housing and which lowers resolution;

detecting impurity concentration in a region outside of said filter;

detecting impurity concentrations in one or more regions inside of the filter;

estimating a life of the filter in accordance with a result of detection of the impurity concentration in the region outside of the filter; and monitoring the impurity concentration in said one or more regions inside of the filter, wherein said step of estimating a life of the filter comprises integrating the impurity concentrations detected in the region outside of the filter for an operating time, and estimating the life of the filter based on the integrated value.

30. A processing method for processing an object, comprising the steps of:

transferring an object selectively to and from a plurality of process units arranged within a housing;

subjecting the object to a series of processes including, coating of processing solution, exposure and development in said process units;

removing, by means of a filter, impurity which is contained in air introduced into the housing and which lowers resolution;

detecting impurity concentration in a region outside of said filter;

detecting impurity concentration in one or more regions inside of the filter;

estimating a life of the filter in accordance with a result of detection of the impurity concentration in the region outside the filter; and monitoring the impurity concentration in said one or more regions inside of the filter, wherein at least one of the process units has a door which is closed while the object is under treatment, and said processing method further comprises the step of issuing a warning when the door of said at least one process unit is opened.

31. The processing method according to claim 30, further comprising the step of inhibiting transferring the object to said at least one process unit whose door is opened and stopping detection of the impurity concentration in said at least one process unit.

32. A processing method for processing an object comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into the housing and which lowers resolution;

detecting impurity concentration in a region outside of said filter;

detecting impurity concentration in one or more regions of the processing apparatus inside of the filter;

estimating a life of the filter in accordance with a result of detection of the impurity concentration in the region outside of the filter; and monitoring the impurity concentration in said one or more regions inside of the filter, monitoring the impurity concentration in said one or more regions inside of the filter, wherein the filter includes a plurality of filter members arranged in layers, said processing method further comprises the step of detecting impurity concentrations in a region between adjacent two of said filter, and said step of estimating a life of the filter comprises detecting the impurity concentrations in the region outside of the layers of the filters and the impurity concentrations in the region between adjacent two of said filter members.

33. A processing method of processing an object, comprising the steps of:

transferring an object selectively to and from a plurality of process units arranged within a housing;

subjecting the object to a series of processes including coating of processing solution, exposure and development in said process units;

removing, by means of a filter, impurity which is contained in air introduced into the housing and which lowers resolution;

detecting concentration of the impurity in a region outside of the filter;

detecting concentration of the impurity in one or more regions inside of the filter;

estimating a life of the filter in accordance with a result of detection of the impurity concentration in the region outside of the filter;

comparing the impurity concentration in said one or more regions inside of the filter with a preset threshold; and issuing a warning if the impurity concentration detected in said one or more regions inside of the filter is higher than the preset threshold.

34. The processing method according to claim 33, wherein said step of estimating a life of the filter comprises integrating the concentration of the impurity detected in the region outside of the filter for an operating time, and estimating the life of the filter based on the integrated value.

35. The processing method according to claim 33, wherein said step of comparing the impurity concentration in said one or more regions inside of the filter with a preset threshold comprises stopping process of the object if the impurity concentration is found to be higher than the preset threshold.

36. The processing method according to claim 33, further comprising the step of inhibiting the object from being transferring to said one or more regions inside of the filter if the impurity concentration in said one or more regions is higher than the preset threshold.

37. The processing method according to claim 33, further comprising the step of repeating detection a predetermined number of times if the impurity concentration detected in said one or more regions inside of the filter is higher than the preset threshold, issuing a warning if the detected impurity concentration remains higher than the preset threshold after the detection is repeated the predetermined number of times, and stopping the repeated detection when the detected impurity concentration has become lower than or equal to the preset threshold while the detection is repeated.

38. The processing method according to claim 37, further comprising the step of repeating detection a predetermined number of times if the impurity concentration detected in the region outside of the filter is higher than a preset value, issuing a warning if the detected impurity concentration remains higher than the preset value after the detection is repeated the predetermined number of times, and stopping the repeated detection when the detected impurity concentration has become lower than or equal to the preset value while the detection is repeated.

39. The processing method according to claim 33, wherein at least one of the process units has a door which is closed while the object is under treatment, and said processing method further comprises the step of issuing a warning when the door of said at least one process unit is opened.

40. The processing method according to claim 39, further comprising the step of inhibiting transferring the object to said at least one process unit whose door is opened and stopping detection of the impurity concentration in said at least one process unit.

41. The processing method according to claim 33, wherein the filter includes a plurality of filters arranged in layers, said processing method further comprises the step of detecting concentration of the impurity in a region between adjacent layers of the filters, and said step of estimating a life of the filter comprises detecting the impurity concentration in the region outside of the layers of the filters and the impurity concentration in the region between adjacent layers of the filters.

* * * * *